US010589399B2

(12) United States Patent
Oh et al.

(10) Patent No.: US 10,589,399 B2
(45) Date of Patent: Mar. 17, 2020

(54) TEXTURED SMALL PAD FOR CHEMICAL MECHANICAL POLISHING

(71) Applicant: Applied Materials, Inc., Santa Clara, CA (US)

(72) Inventors: Jeonghoon Oh, Saratoga, CA (US); Edwin C. Suarez, Fremont, CA (US); Jason Garcheung Fung, Santa Clara, CA (US); Eric Lau, Santa Clara, CA (US); King Yi Heung, Santa Clara, CA (US); Ashwin Murugappan Chockalingam, San Jose, CA (US); Daniel Redfield, Morgan Hill, CA (US); Charles C. Garretson, Sunnyvale, CA (US); Thomas H. Osterheld, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 205 days.

(21) Appl. No.: 15/461,944

(22) Filed: Mar. 17, 2017

(65) Prior Publication Data

US 2017/0274498 A1 Sep. 28, 2017

Related U.S. Application Data

(60) Provisional application No. 62/313,023, filed on Mar. 24, 2016.

(51) Int. Cl.
*B24B 37/26* (2012.01)
*B24B 37/10* (2012.01)

(52) U.S. Cl.
CPC ..... *B24B 37/26* (2013.01); *B24B 37/10* (2013.01)

(58) Field of Classification Search
None
See application file for complete search history.

(56) References Cited

U.S. PATENT DOCUMENTS 5,020,283 A 6/1991 Tuttle
5,177,908 A 1/1993 Tuttle
(Continued)

FOREIGN PATENT DOCUMENTS

JP 2002-103211 4/2002

OTHER PUBLICATIONS

International Search Report and Written Opinion in International Application No. PCT/US2015/040065, dated Sep. 30, 2015, 9 pages.

(Continued)

*Primary Examiner* — Sylvia MacArthur
(74) *Attorney, Agent, or Firm* — Fish & Richardson P.C.

(57) ABSTRACT

A chemical mechanical polishing system includes a substrate support configured to hold a substrate, a polishing pad assembly include a membrane and a polishing pad portion having a polishing surface, a polishing pad carrier, and a drive system configured to cause relative motion between the substrate support and the polishing pad carrier. The polishing pad portion is joined to the membrane on a side opposite the polishing surface. The polishing surface has a width parallel to the polishing surface at least four times smaller than a diameter of the substrate. An outer surface of the polishing pad portion includes at least one recess and at least one plateau having a top surface that provides the polishing surface. The polishing surface has a plurality of edges defined by intersections between side walls of the at least one recess and a top surface of the at least one plateau.

5 Claims, 7 Drawing Sheets

(56) References Cited

U.S. PATENT DOCUMENTS

| | | | | |
|---|---|---|---|---|
| 5,297,364 | A | 3/1994 | Tuttle | |
| 5,310,455 | A * | 5/1994 | Pasch | B24B 37/22 156/211 |
| 5,384,986 | A | 1/1995 | Hirose | |
| 5,558,563 | A | 9/1996 | Cote | |
| 5,578,362 | A | 11/1996 | Reinhardt | |
| 5,664,989 | A | 9/1997 | Nakata | |
| 5,785,584 | A | 7/1998 | Marmillion | |
| 5,897,424 | A | 4/1999 | Evans | |
| 5,921,855 | A | 7/1999 | Osterheld et al. | |
| 5,938,504 | A | 8/1999 | Talieh | |
| 5,980,685 | A | 11/1999 | Kimura | |
| 6,273,806 | B1 | 8/2001 | Bennett et al. | |
| 6,315,641 | B1 | 11/2001 | Lee et al. | |
| 6,328,629 | B1 | 12/2001 | Togawa | |
| 6,331,137 | B1 | 12/2001 | Raeder et al. | |
| 6,332,830 | B1 | 12/2001 | Okamura et al. | |
| 6,464,574 | B1 | 10/2002 | Halley | |
| 6,514,123 | B1 | 2/2003 | Crevasse | |
| 6,517,419 | B1 | 2/2003 | Halley | |
| 6,561,881 | B2 | 5/2003 | Jeong | |
| 7,238,093 | B1 | 7/2007 | Sakamoto | |
| 7,267,610 | B1 | 9/2007 | Elmufdi et al. | |
| 8,123,597 | B2 * | 2/2012 | Chiu | B24B 37/26 451/527 |
| 8,851,959 | B2 | 10/2014 | Jiang et al. | |
| 10,105,812 | B2 | 10/2018 | Chen | |
| 2001/0005667 | A1 | 6/2001 | Tolles et al. | |
| 2001/0019934 | A1 | 9/2001 | Nishimura et al. | |
| 2002/0037649 | A1 | 3/2002 | Shingu | |
| 2002/0132566 | A1 | 9/2002 | Jeong | |
| 2003/0119431 | A1 | 6/2003 | Boyd et al. | |
| 2003/0168169 | A1 | 9/2003 | Ishikawa et al. | |
| 2008/0293332 | A1 | 11/2008 | Watanabe et al. | |
| 2011/0195639 | A1 | 8/2011 | Chen | |
| 2012/0171933 | A1 | 7/2012 | Chen et al. | |
| 2014/0209239 | A1 | 7/2014 | Ko et al. | |
| 2015/0111478 | A1 | 4/2015 | Chen et al. | |
| 2016/0016280 | A1 * | 1/2016 | Chen | B24B 37/10 438/692 |
| 2016/0016281 | A1 * | 1/2016 | Chen | B24B 37/10 156/345.12 |
| 2016/0016282 | A1 | 1/2016 | Chen | |
| 2017/0203405 | A1 * | 7/2017 | Chen | B24B 37/20 |
| 2017/0274498 | A1 * | 9/2017 | Oh | B24B 37/26 |
| 2019/0047110 | A1 | 2/2019 | Chen | |

OTHER PUBLICATIONS

International Search Report and Written Opinion in International Application No. PCT/US2017/022924, dated Jun. 29, 2017, 14 pages.

* cited by examiner

TEXTURED SMALL PAD FOR CHEMICAL MECHANICAL POLISHING

CROSS REFERENCE TO RELATED APPLICATIONS

This application claims priority to U.S. Provisional Patent Application No. 62/313,023, filed on Mar. 24, 2016, the entire content of which is hereby incorporated by reference.

TECHNICAL FIELD

This disclosure relates to chemical mechanical polishing (CMP).

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

SUMMARY

The present disclosure provides a textured polishing pad that is smaller than the substrate to be polished.

In one aspect, a chemical mechanical polishing system includes a substrate support configured to hold a substrate during a polishing operation, a polishing pad assembly include a membrane and a polishing pad portion having a polishing surface, a polishing pad carrier to hold the polishing pad assembly and press the polishing surface against the substrate, and a drive system configured to cause relative motion between the substrate support and the polishing pad carrier. The polishing pad portion is joined to the membrane on a side opposite the polishing surface. The polishing surface has a width parallel to the polishing surface at least four times smaller than a diameter of the substrate. An outer surface of the polishing pad portion includes at least one recess and at least one plateau having a top surface that provides the polishing surface. The polishing surface has a plurality of edges defined by intersections between side walls of the at least one recess and a top surface of the at least one plateau.

Implementations may include one or more of the following features.

The at least one recess may include a first plurality of parallel grooves. The at least one recess may include a second plurality of parallel grooves perpendicular to the first plurality of grooves. The first plurality of parallel grooves may be exactly two to six grooves, and the second plurality of grooves may be the same number of grooves.

The membrane and the polishing pad portion may be a unitary body, or the polishing pad portion may be secured to the membrane by an adhesive. The membrane may include a first portion surrounded by a less flexible second portion, and the polishing pad portion may be joined to the first portion.

In another aspect, a polishing pad assembly include a circular membrane and aa circular polishing pad portion having a polishing surface to contact the substrate during the polishing operation. The polishing pad portion may have a diameter at least five times smaller than a diameter of the membrane. The polishing pad portion may be positioned at about a center of the circular membrane. An upper surface of the polishing pad portion nay include one or more recesses and one or more plateaus having a top surface that provides the polishing surface. The polishing surface may have a plurality of edges defined by intersections between side walls of the one or more recesses and the top surface of the one or more plateaus.

Implementations may include one or more of the following features.

The one or more recesses may include a first plurality of parallel grooves. The one or more recesses may include a second plurality of parallel grooves perpendicular to the first plurality of grooves. The first plurality of parallel grooves may be exactly two to six grooves, and the second plurality of grooves may be the same number of grooves.

The one or more recesses may include a plurality of recesses that extend radially inwardly from a circular perimeter of the polishing pad portion. The one or more recesses may include a plurality of concentric annular grooves. The one or more plateaus may include a plurality of separate projections. The projections may be circular. The projections may be separated by gaps and a width in the direction parallel to the polishing pad surface of the plateaus is about one to five times a width of the gaps between adjacent plateaus. The one or more plateaus may include an interconnected rectangular grid.

The membrane and the polishing pad portion may be a unitary body, or the polishing pad portion may be secured to the membrane by an adhesive.

In another aspect, a polishing pad assembly includes a membrane and a convex polygonal polishing pad portion having a polishing surface to contact the substrate during the polishing operation. The polishing pad portion has a width at least five times smaller than a width of the membrane. The polishing pad portion is positioned at about a center of the circular membrane. An upper surface of the polishing pad portion includes one or more recesses and one or more plateaus having a top surface that provides the polishing surface. The polishing surface has a plurality of edges defined by intersections between side walls of the one or more recesses and the top surface of the one or more plateaus.

Advantages may optionally include (but are not limited to) one or more of the following.

A small pad that undergoes, e.g., an orbiting motion, can be used to compensate for non-concentric polishing uniformity. The orbital motion can provide an acceptable polishing rate while avoiding overlap of the pad with regions that are not desired to be polished, thus improving substrate uniformity. In addition, in contrast with rotation, an orbital motion that maintains a fixed orientation of the polishing pad relative to the substrate can provide a more uniform polishing rate across the region being polished.

The texturing of the pad may provide an increased polishing rate.

Other aspects, features, and advantages of the invention will be apparent from the description and drawings, and from the claims.

DESCRIPTION OF DRAWINGS

Like reference symbols in the various drawings indicate like elements.

DETAILED DESCRIPTION

1. Introduction

Some chemical mechanical polishing processes result in thickness non-uniformity across the surface of the substrate. For example, a bulk polishing process can result in underpolished regions on the substrate. To address this problem, after the bulk polishing it is possible to perform a "touch-up" polishing process that focuses on portions of the substrate that were underpolished.

Some bulk polishing processes result in localized non-concentric and non-uniform spots that are underpolished. A polishing pad that rotates about a center of the substrate may be able to compensate for concentric rings of non-uniformity, but may not be able to address localized non-concentric and non-uniform spots. However, a small pad that undergoes an orbiting motion can be used to compensate for non-concentric polishing non-uniformity.

Figure 1:
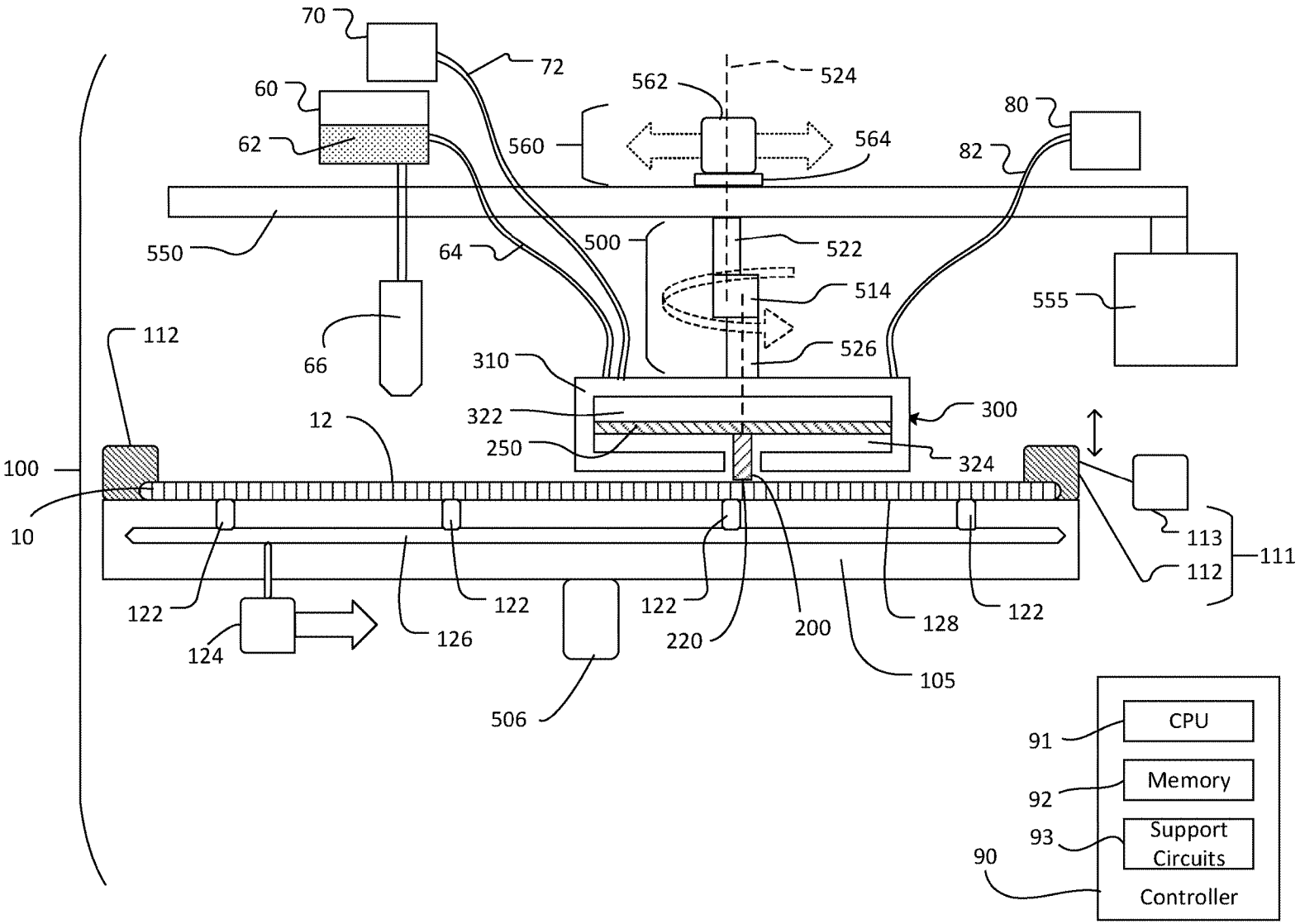
FIG. 1 is a schematic cross-sectional side view of a polishing system.

Referring to FIG. 1, a polishing apparatus 100 for polishing localized regions of the substrate includes a substrate support 105 to hold a substrate 10, and a movable polishing pad carrier 300 to hold a polishing pad portion 200. The polishing pad portion 200 includes a polishing surface 220 that has a smaller diameter than the radius of the substrate 10 being polished. For example, the diameter of the polishing pad portion 200 can be at least two times small, e.g., at least four times small, e.g., at least ten times smaller, e.g., at least twenty times smaller, than the diameter of the substrate 10.

The polishing pad carrier 300 is suspended from a polishing drive system 500 which will provide motion of the polishing pad carrier 300 relative to the substrate 10 during a polishing operation. The polishing drive system 500 can be suspended from a support structure 550.

In some implementations, a positioning drive system 560 is connected to the substrate support 105 and/or the polishing pad carrier 300. For example, the polishing drive system 500 can provide the connection between the positioning drive system 560 and the polishing pad carrier 300. The positioning drive system 560 is operable to position the pad carrier 300 at a desired lateral position above the substrate support 105.

For example, the support structure 550 can include two linear actuators 562 and 564, which are oriented to provide motion in two perpendicular directions over the substrate support 105, to provide the positioning drive system 560. Alternatively, the substrate support 105 could be supported by the two linear actuators. Alternatively, the substrate support 105 could be supported by one linear actuator and the polishing pad carrier 300 could be supported by the other linear actuator. Alternatively, the substrate support 105 can be rotatable, and the polishing pad carrier 300 can be suspended from a single linear actuator that provides motion along a radial direction. Alternatively, the polishing pad carrier 300 can be suspended from a rotary actuator and the substrate support 105 can be rotatable with a rotary actuator. Alternatively, the support structure 550 can be an arm that is pivotally attached to a base located off to the side of the substrate 105, and the substrate support 105 could be supported by a linear or rotary actuator.

Optionally, a vertical actuator can be connected to the substrate support 105 and/or the polishing pad carrier 300. For example, the substrate support 105 can be connected to a vertically drivable piston 506 that can lift or lower the substrate support 105. Alternatively or in addition, a vertically drivable piston could be included in the positioning system 500 so as to lift or lower the entire polishing pad carrier 300.

The polishing apparatus 100 optionally includes a reservoir 60 to hold a polishing liquid 62, such as an abrasive slurry. As discussed below, in some implementations the slurry is dispensed through the polishing pad carrier 300 onto the surface 12 of the substrate 10 to be polished. A conduit 64, e.g. flexible tubing, can be used to transport the polishing fluid from the reservoir 60 to the polishing pad carrier 300. Alternatively or in addition, the polishing apparatus could include a separate port 66 to dispense the polishing liquid. The polishing apparatus 100 can also include a polishing pad conditioner to abrade the polishing pad 200 to maintain the polishing pad 200 in a consistent abrasive state. The reservoir 60 can include a pump to supply the polishing liquid at a controllable rate through the conduit 64.

The polishing apparatus 100 can include a source 70 of cleaning fluid, e.g., a reservoir or supply line. The cleaning fluid can be deionized water. A conduit 72, e.g., flexible tubing, can be used to transport the polishing fluid from the reservoir 70 to the polishing pad carrier 300.

The polishing apparatus 100 includes a controllable pressure source 80, e.g., a pump, to apply a controllable pressure to the interior of the polishing pad carrier 300. The pressure source 80 can be connected to the polishing pad carrier 300 by a conduit 82, such as flexible tubing.

Each of the reservoir 60, cleaning fluid source 70 and controllable pressure source 80 can be mounted on the support structure 555 or on a separate frame holding the various components of the polishing apparatus 100.

In operation, the substrate 10 is loaded onto the substrate support 105, e.g., by a robot. In some implementations, the positioning drive system 560 moves the polishing pad carrier 500 such that the polishing pad carrier 500 is not directly above the substrate support 105 when the substrate 10 is loaded. For example, if the support structure 550 is a pivotable arm, the arm could swing such that the polishing pad carrier 300 is off to the side of the substrate support 105 during substrate loading.

Then the positioning drive system 560 positions the polishing pad carrier 300 and polishing pad 200 at a desired position on the substrate 10. The polishing pad 200 is brought into contact with the substrate 10. For example, the polishing pad carrier 300 can actuate the polishing pad 200 to press it down on the substrate 10. Alternatively or in addition, one or more vertical actuators could lower the entire polishing pad carrier 300 and/or lift the substrate support to bring into contact with the substrate 10. The polishing drive system 500 generates the relative motion between the polishing pad carrier 300 and the substrate support 105 to cause polishing of the substrate 10.

During the polishing operation, the positioning drive system 560 can hold the polishing drive system 500 and substrate 10 substantially fixed relative to each other. For example, the positioning system can hold the polishing drive system 500 stationary relative to the substrate 10, or can sweep the polishing drive system 500 slowly (compared to the motion provided to the substrate 10 by the polishing drive system 500) across the region to be polished. For example, the instantaneous velocity provided to the substrate 10 by the positioning drive system 560 can be less than 5%, e.g., less than 2%, of the instantaneous velocity provided to the substrate 10 by the polishing drive system 500.

The polishing system also includes a controller 90, e.g., a programmable computer. The controller can include a central processing unit 91, memory 92, and support circuits 93. The controller's 90 central processing unit 91 executes instructions loaded from memory 92 via the support circuits 93 to allow the controller to receive input based on the environment and desired polishing parameters and to control the various actuators and drive systems.

2. The Substrate Support

Referring to FIG. 1, the substrate support 105 is plate-shaped body situated beneath the polishing pad carrier 300. The upper surface 128 of the body provides a loading area large enough to accommodate a substrate to be processed. For example, the substrate can be a 200 to 450 mm diameter substrate. The upper surface 128 of the substrate support 105 contacts the back surface of the substrate 10 (i.e., the surface that is not being polished) and maintains its position.

The substrate support 105 is about the same radius as the substrate 10, or larger. In some implementations, the substrate support 105 is slightly narrower than the substrate, e.g., by 1-2% of the substrate diameter. In this case, when placed on the support 105, the edge of the substrate 10 slightly overhangs the edge of the support 105. This can provide clearance for an edge grip robot to place the substrate on the support. In some implementations, the substrate support 105 is wider than the substrate, e.g., by 1-10% of the substrate diameter. In either case, the substrate support 105 can make contact with a majority of the surface the backside of the substrate.

In some implementations, the substrate support 105 maintains the substrate 10 position during polishing operation with a clamp assembly 111. For example, the clamp assembly 111 can be where the substrate support 105 is wider than the substrate 10. In some implementations, the clamp assembly 111 can be a single annular clamp ring 112 that contacts the rim of the top surface of the substrate 10. Alternatively, the clamp assembly 111 can include two arc-shaped clamps 112 that contact the rim of the top surface on opposite sides of the substrate 10. The clamps 112 of the clamp assembly 111 can be lowered into contact with the rim of the substrate by one or more actuators 113. The downward force of the clamp restrains the substrate from moving laterally during polishing operation. In some implementations, the clamp(s) include downwardly a projecting flange 114 that surrounds the outer edge of the substrate.

Alternatively or in addition, the substrate support 105 is a vacuum chuck. In this case, the top surface 128 of the support 105 that contacts the substrate 10 includes a plurality of ports 122 connected by one or more passages 126 in the support 105 to a vacuum source 126, such as a pump. In operation, air can be evacuated from the passages 126 by the vacuum source 126, thus applying suction through the ports 122 to hold the substrate 10 in position on the substrate support 105. The vacuum chuck can be whether the substrate support 105 is wider or narrower than the substrate 10.

In some implementations, the substrate support 105 includes a retainer to circumferentially surround the substrate 10 during polishing. The various substrates support features described above can be optionally be combined with each other. For example, the substrate support can include both a vacuum chuck and a retainer.

3. The Polishing Pad

Figure 2:
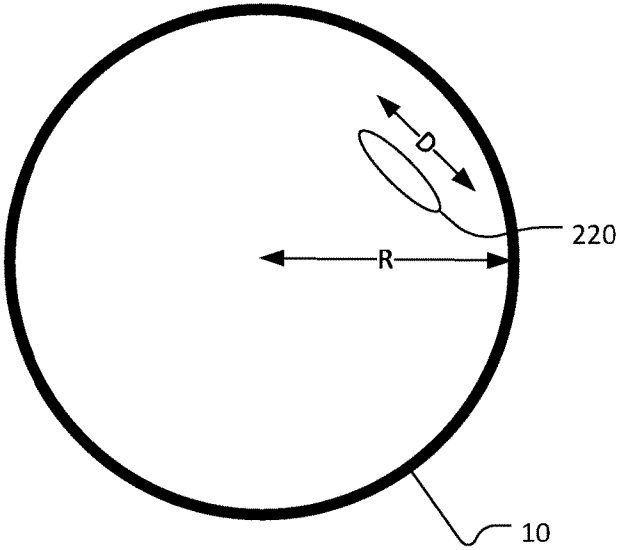
FIG. 2 is a schematic top view illustrating a loading area of a polishing pad portion on a substrate.

Referring to FIGS. 1 and 2, the polishing pad portion 200 has a polishing surface 220 that is brought into contact with the substrate 10 in a contact area, also called a loading area, during polishing. The polishing surface 220 can have a largest lateral dimension D that is smaller diameter than the radius of the substrate 10. For example, for the largest lateral diameter of the polishing pad can be about can be about 5-10% of the diameter of the substrate. For example, for wafer that ranges from 200 mm to 300 mm in diameter, the polishing pad surface 220 can have a largest lateral dimension of 2-30 mm, e.g., 3-10 mm, e.g., 3-5 mm. Smaller pads provide more precision but are slower to use.

The lateral cross-sectional shape, i.e., a cross-section parallel to the polishing surface 220, of the polishing pad portion 200 (and the polishing surface 220) can be nearly any shape, e.g., circular, square, elliptical, or a circular arc.

Referring to FIGS. 1 and 3A-3D, the polishing pad portion 200 is joined to a membrane 250 to provide a polishing pad assembly 240. As discussed below, the membrane 250 is configured to flex, such that a central area 252 of the membrane 250 to which the polishing pad portion 200 is joined can undergo vertical deflection while the edges 254 of the membrane 250 remain vertically stationary.

The membrane 250 has a lateral dimension L that is larger than the largest lateral dimension D of the polishing pad portion 200. The membrane 250 can be thinner than the polishing pad portion 200. The side walls 202 of the polishing pad portion 200 can extend substantially perpendicular to the membrane 250.

Figure 3A:
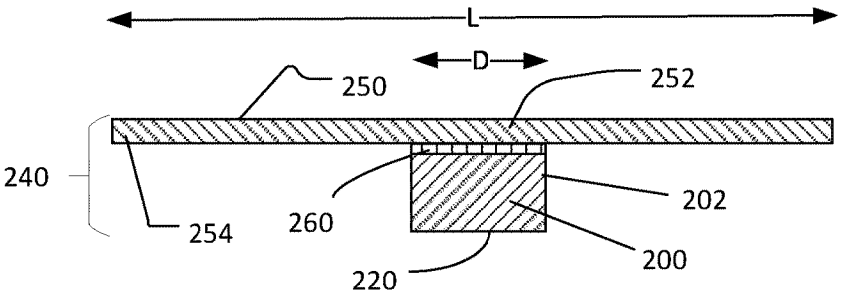
FIGS. 3A-3E are schematic cross-sectional views of a polishing pad assembly.

In some implementations, e.g., as shown in FIG. 3A, the top of the polishing pad portion 200 is secured to the bottom of the membrane 250 by an adhesive 260. The adhesive can be an epoxy, e.g., a UV-curable epoxy. In this case, the polishing pad portion 200 and membrane 250 can be fabricated separately, and then joined together.

Figure 3B:
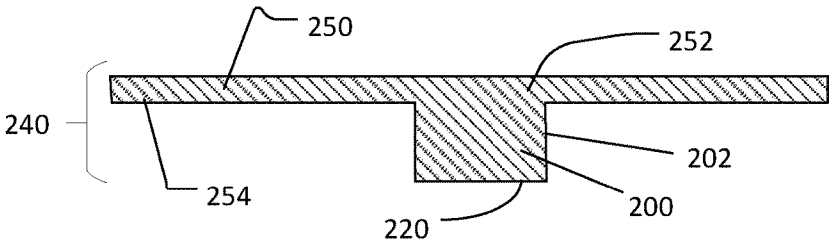

In some implementations, e.g., as shown in FIG. 3B, the polishing pad assembly, including the membrane 250 and the polishing pad portion 200, is a single unitary body, e.g., of homogenous composition. For example, the entire polishing pad assembly 250 can be formed by injection molding in a mold having the complementary shape. Alternatively, the polishing pad assembly 250 could be formed in a block, and then machined to thin the section corresponding to the membrane 250.

The polishing pad portion 200 can be a material suitable for contacting the substrate during chemical mechanical polishing. For example, the polishing pad material can include polyurethane, e.g., a microporous polyurethane, for example, an IC-1000 material.

Where the membrane 250 and polishing pad portion 200 are formed separately, the membrane 250 can be softer than the polishing pad material. For example, the membrane 250 can have a hardness of about 60-70 Shore D, whereas the polishing pad portion 200 can have a hardness of about 80-85 Shore D.

Alternatively the membrane 250 can be more flexible, but less compressible, than the polishing pad portion 200. For example, the membrane can be a flexible polymer, such as polyethylene terephthalate (PET).

The membrane 250 can formed of a different material than the polishing pad portion 200, or can be formed of the essentially the same material but with a different degree of cross-linking or polymerization. For example, both the membrane 250 and the polishing pad portion 200 can be polyurethane, but the membrane 250 can be cured less than the polishing pad portion 200 such that it is softer.

Figure 3C:
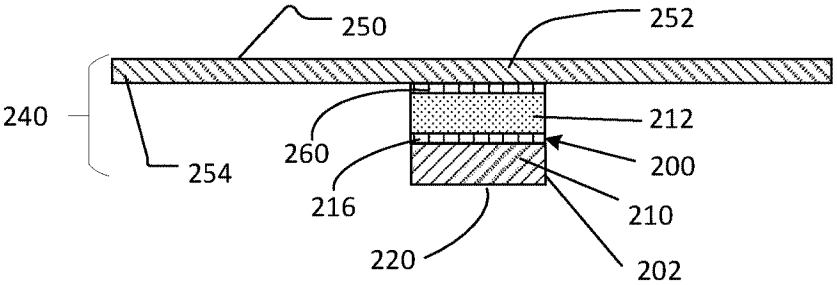

In some implementations, e.g., as shown in FIG. 3C, the polishing pad portion 200 can include two or more layers of different composition, e.g., a polishing layer 210 having the polishing surface 220, and a more compressible backing layer 212 between the membrane 250 and the polishing layer 210. Optionally, an intermediate adhesive layer 26, e.g., a pressure sensitive adhesive layer, can be used to secure the polishing layer 210 to the backing layer 212.

The polishing pad portion having multiple layers of different composition is also applicable to the implementation shown in FIG. 3B. In this case the membrane 250 and the backing layer 212 can be is a single unitary body, e.g., of homogenous composition. So the membrane 250 is a portion of the backing layer 212.

Figure 3D:
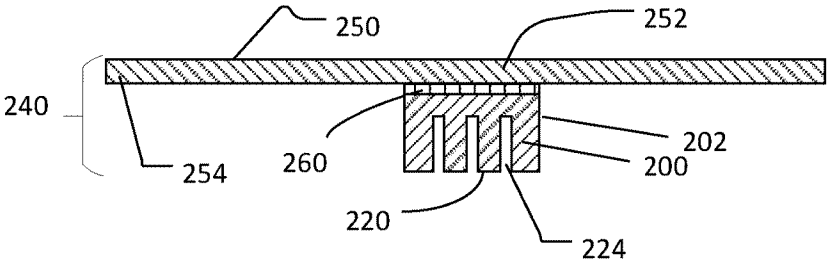

In some implementations, as shown in FIG. 3D (but also applicable to the implementations shown in FIGS. 3B and 3C), the bottom surface of the polishing pad portion 200 can include recesses 224 to permit transport of slurry during a polishing operation. The recesses 224 can be shallower than the depth of the polishing pad portion 200 (e.g., shallower than the polishing layer 210).

Figure 3E:
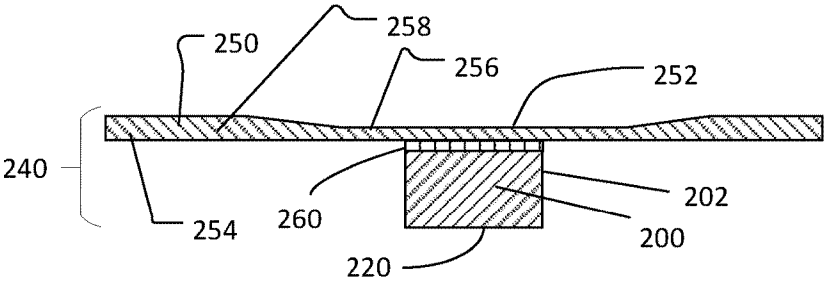

In some implementations, e.g., as shown in FIG. 3E (but also applicable to the implementations shown in FIGS. 3B-3E), the membrane 250 includes a thinned section 256 around the central section 252. The thinned section 256 is thinner than a surrounding portion 258. This increases flexibility of the membrane 200 to permit greater vertical deflection under applied pressure.

The perimeter 254 of the membrane 250 can include a thickened rim or other features to improve sealing to the polishing pad carrier 300.

A variety of geometries are possible for the lateral cross-sectional shape of the polishing surface 220. Referring to FIG. 4A, the polishing surface 220 of the polishing pad portion 200 can be a circular area.

Referring to FIG. 1, the largest lateral dimension of the membrane 250 is smaller than the smallest lateral dimension of the substrate support 105. Similarly, the largest lateral dimension of the membrane 250 is smaller than the smallest lateral dimension of the substrate 10.

Figure 4B:
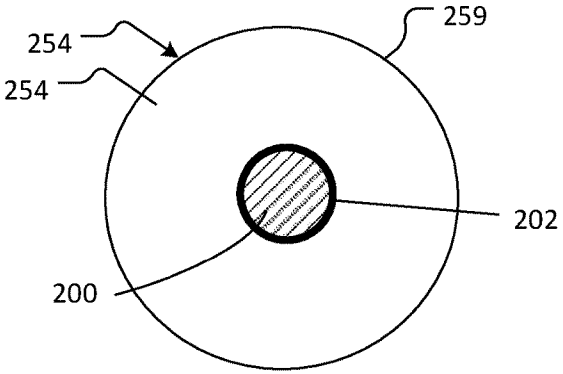
FIG. 4B is a schematic bottom view of a polishing pad assembly.
Figure 4A:
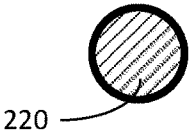
FIG. 4A is a schematic bottom view of the polishing surface a polishing pad assembly.

Referring to FIG. 4B, the membrane 250 extends beyond the outer side walls 202 of the polishing pad portion 200 on all sides of the polishing pad portion 200. The polishing pad portion 200 can be equidistant from the two closest opposing edges of the membrane 250. The polishing pad portion 200 can be located in the center of the membrane 250.

The smallest lateral dimension of the membrane 250 can be about five to fifty times larger than the corresponding lateral dimension of the polishing pad portion. The smallest (lateral) circumference dimension of the membrane 250 can be about 260 mm to 300 mm. In general, the size of the membrane 250 depends on its flexibility; the size can be selected such that the center of the membrane undergoes a desired amount of vertical deflection at a desired pressure. The polishing pad portion 200 can have a diameter of about 5 to 20 mm. The membrane 250 can have a diameter of about four to twenty times the diameter of the polishing pad portion 200.

The pad portion 200 can have a thickness of about 0.5 to 7 mm, e.g., about 2 mm. The membrane 250 can have a thickness of about 0.125 to 1.5 mm, e.g., about 0.5 mm.

The perimeter 259 of the membrane 250 can generally mimic the perimeter of the polishing pad portion. For example, as shown in FIG. 4B, if the polishing pad portion 200 is circular, the membrane 250 can be circular as well. However, the perimeter 259 of the membrane 250 can be smoothly curved so that it does not include sharp corners. For example, if the polishing pad portion 200 is square, the membrane 250 can be a square with rounded corners or a squircle.

Referring to FIGS. 5A-5F, the polishing surface 220 of the polishing pad portion 200 can be textured, e.g., include recesses 224. In some configurations, the recesses 224 can increase the polishing rate. Without being limited to any particular theory, when polishing with a small polishing pad, the polishing rate can be affected by the number of "edges," i.e., intersections between vertical side surfaces of the recesses and the horizontal surfaces of the resulting plateaus. Although grooves can be used in larger pads (i.e., pads that are larger than the substrate), at the distance scale of a small pad, slurry distribution could be considered less of a concern. For example, the roughened surface of the polishing pad may sufficiently distribute the slurry at the distance scale of a small pad, so grooves may not be necessary for slurry distribution.

Figure 5A:
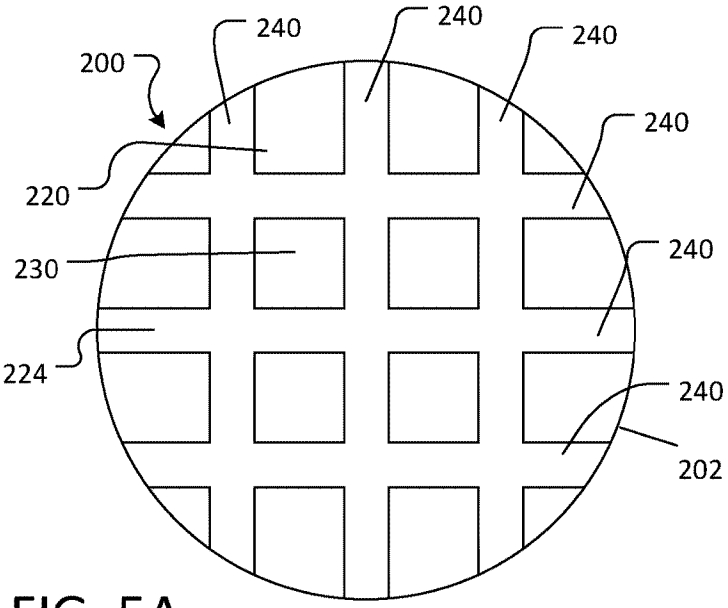
FIG. 5A is a schematic bottom view of a polishing pad portion of the polishing pad assembly.

Referring to FIG. 5A, in some implementations, the recess 224 is provided by a plurality of grooves that divide the polishing surface into separate plateaus 230. For example, the grooves can include a first plurality of parallel grooves 240, and a second plurality of parallel grooves 242 that are perpendicular to the first plurality of grooves. Thus, the grooves form an interconnected rectangular grid, e.g., a square grid, with rectangular individual separate plateaus 224 (excepting where the plateaus are chopped off by the edge 202 of the polishing pad portion). There can be just a few grooves, e.g., two to six grooves for the first plurality and similarly two to six grooves for the second plurality. The ratio of the width of the grooves (in the direction parallel to the polishing pad surface 220) to the pitch of the grooves can be about 1:2.5 to 1:4. The grooves 240, 242 can about 0.4-2 mm wide, e.g., about 0.8 mm, and can have a pitch of about 2-6 mm, e.g., about 2.5 mm.

Figure 5B:
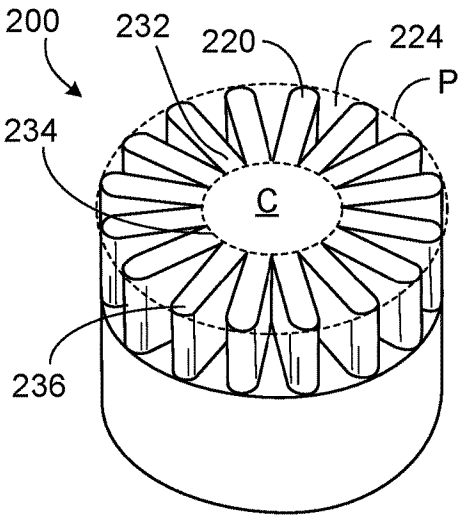
FIGS. 5B-5G are schematic perspective views of a polishing pad portion of the polishing pad assembly.

Referring to FIG. 5B, in some implementations, the recesses 224 extend radially inwardly from the circular perimeter P of the polishing pad portion 200. The recesses 224 can extend only partially from the perimeter P to the center C, e.g., by 20-80% of the pad radius. The resulting polishing pad surface 220 includes a single plateau 232 that includes a central region 234 without recesses, and a plurality of partitions 236 extending outwardly from the central region 234. The central region 234 can be circular. The polishing pad portion 200 could include six to thirty radially-extending partitions 236. The recesses 224 can be configured such that the partitions 236 can have substantially uniform width along their radial length. The ends of the partitions 236 at the perimeter P can be rounded.

Figure 5C:
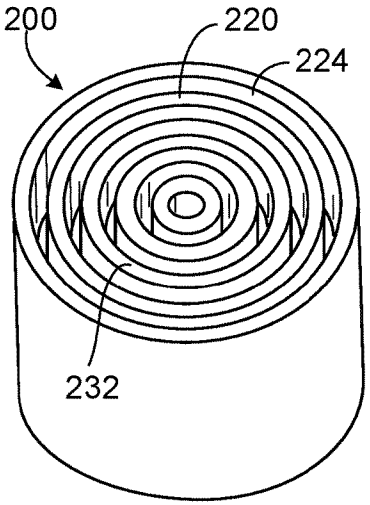

Referring to FIG. 5C, in some implementations, the recesses 224 are concentric circular grooves. The resulting polishing pad surface 220 is formed by a plurality of concentric circular plateaus 232. The plateaus 232 can be spaced uniformly along the radius of the polishing pad portion 200. There can be three to twenty plateaus 232. The width of the circular plateaus 232 can be about 1-5 mm, and the width of the recesses 224 can be about 0.5-3 mm.

Figure 5D:
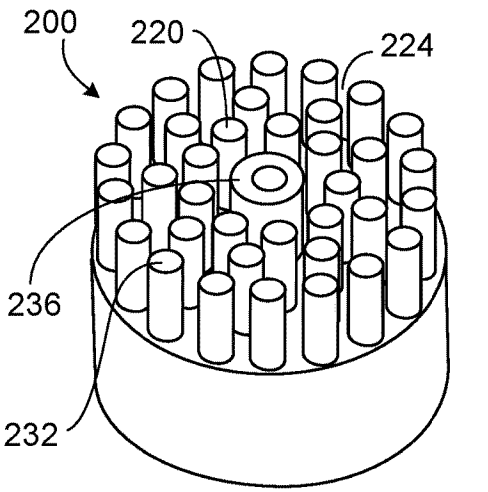

Referring to FIG. 5D, in some implementations, the polishing surface 220 is provided by a plurality of separate projections 232 from the lower portion of the polishing pad portion 200; the recess 224 provides the gap between projections 232. Each projection provides its own plateau that is not surrounded by any other plateau. The individual projections can be circular. The projections 232 can be spread uniformly across the polishing pad portion 200. The width (in the direction parallel to the polishing pad surface 220) of the projections 232 can be about one to two times as large as the width of the gap between adjacent projections 232. The projections 232 can be about 0.5-5 mm wide. The width of the gap between adjacent projections 232 can be about 0.5-3 mm.

Optionally, the central region 230 can include one or more additional recesses, e.g., a circular recess that defines an annular plateau 236. Alternatively, the central region 230 can be formed without recesses. Alternatively, the central region 234 can have the same pattern of projections as the remainder of the polishing pad portion.

Figure 5E:
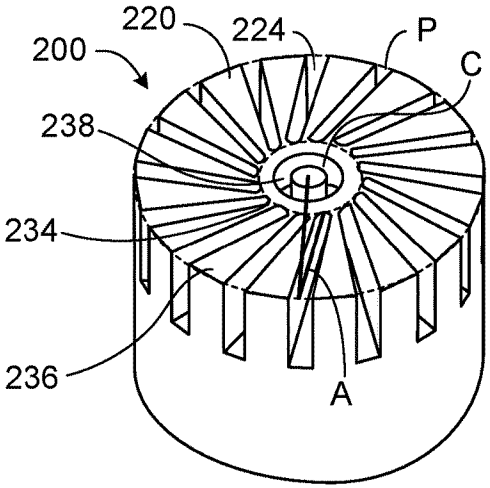

Referring to FIG. 5E, in some implementations, the recesses 224 extend radially inwardly from the circular perimeter P of the polishing pad portion 200. The recesses 224 can extend only partially from the perimeter P to the center C, e.g., by 20-80% of the pad radius. The recesses 224 can have a uniform width along their radial length. The resulting polishing pad surface 220 includes one or more plateaus 232 that include a central region 234 without recesses, and a plurality of partitions 236 (the regions between adjacent recesses) extending outwardly from the central region 234. In particular, the resulting partitions 236 are generally triangular.

The recesses 224 need not extend exactly radially. For example, the recesses 224 can be offset by an angle A of about 10 to 30° from the radial segment passing through the center C and the end of the recess at the perimeter P. The polishing pad portion 200 could include six to thirty radially-extending partitions 236. The central region 234 can include one or more additional recesses, e.g., an annular groove 238. Alternatively, the central region 234 can be formed without recesses.

Figure 5F:
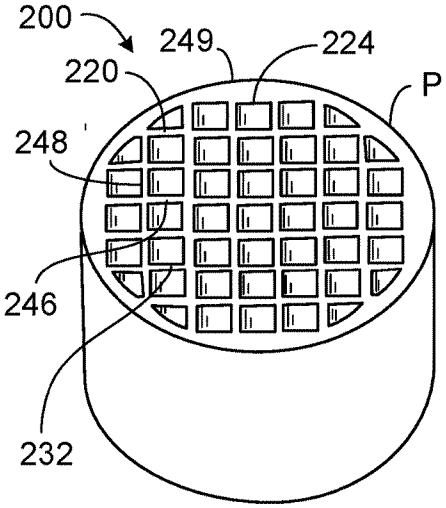

Referring to FIG. 5F, in some implementations, instead of grooves dividing the polishing surface into separate plateaus, the plateau 232 separates the polishing surface into separate recesses. For example, the plateau can include a first plurality of parallel walls 246, and a second plurality of parallel walls 248. The second plurality of walls can be perpendicular to the first plurality of wall. For example, the walls 246, 248 of the plateau 232 can form an interconnected rectangular grid, e.g., a square grid, with rectangular individual separate recesses 224. This configuration can be termed a "waffle" pattern. The walls 246, 248 of the plateau 232 can be spaced uniformly across the polishing pad portion 200. The walls 246, 248 can be about 0.5-5 mm wide (in the direction parallel to the polishing pad surface 220), and the width of the recess between the walls can be about 0.3-4 mm.

An additional partition 249 can be formed at the perimeter P of the polishing pad portion 200. This partition 249 surrounds the rest of the walls 246, 248 to ensure that none of recesses 224 extend to the side wall of the polishing pad portion 200. Assuming the polishing pad portion 200 is circular then the partition 249 is similarly circular.

Figure 5G:
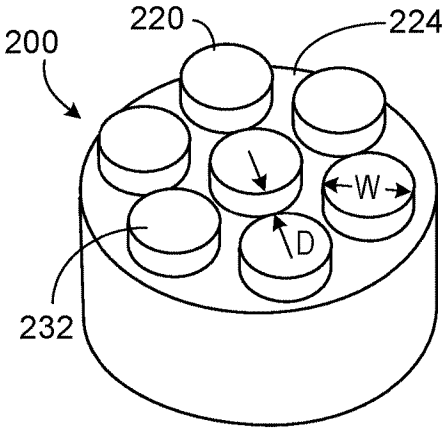

Referring to FIG. 5G, in some implementations, the polishing surface 220 is provided by a plurality of separate projections 232 from the lower portion of the polishing pad portion 200. The projections 232 provide the plateaus. The recess 224 provides the gap between projections 232. The individual projections can be circular. The projections 232 can be spread uniformly across the polishing pad portion 200. The width W (in the direction parallel to the polishing pad surface 220) of the projections 232 can be about two to ten times as large as the width G of the gap between adjacent projections 232. The projections 232 can be about 1-5 mm wide.

In each of the above implementations, a plurality of edges are defined between the polishing surface and the side walls of the more partitions. In addition, in each of the above implementations, the side walls of the plateaus are perpendicular to the polishing surface.

Although polishing pad portions with a circular perimeter are described above, other shapes are possible, e.g., polygonal, such as square, hexagonal rectangular perimeters. In general, the perimeter can form a convex shape, i.e., any line drawn through the shape (and not tangent to an edge or corner) meets the boundary exactly twice.

Some of the configurations described are not feasibly fabricated by conventional techniques, e.g., milling or cutting a groove into a fabricated polishing pad. However, these patterns could be fabricated by 3D printing of the polishing pad portion.

4. The Polishing Pad Carrier

Figure 6:
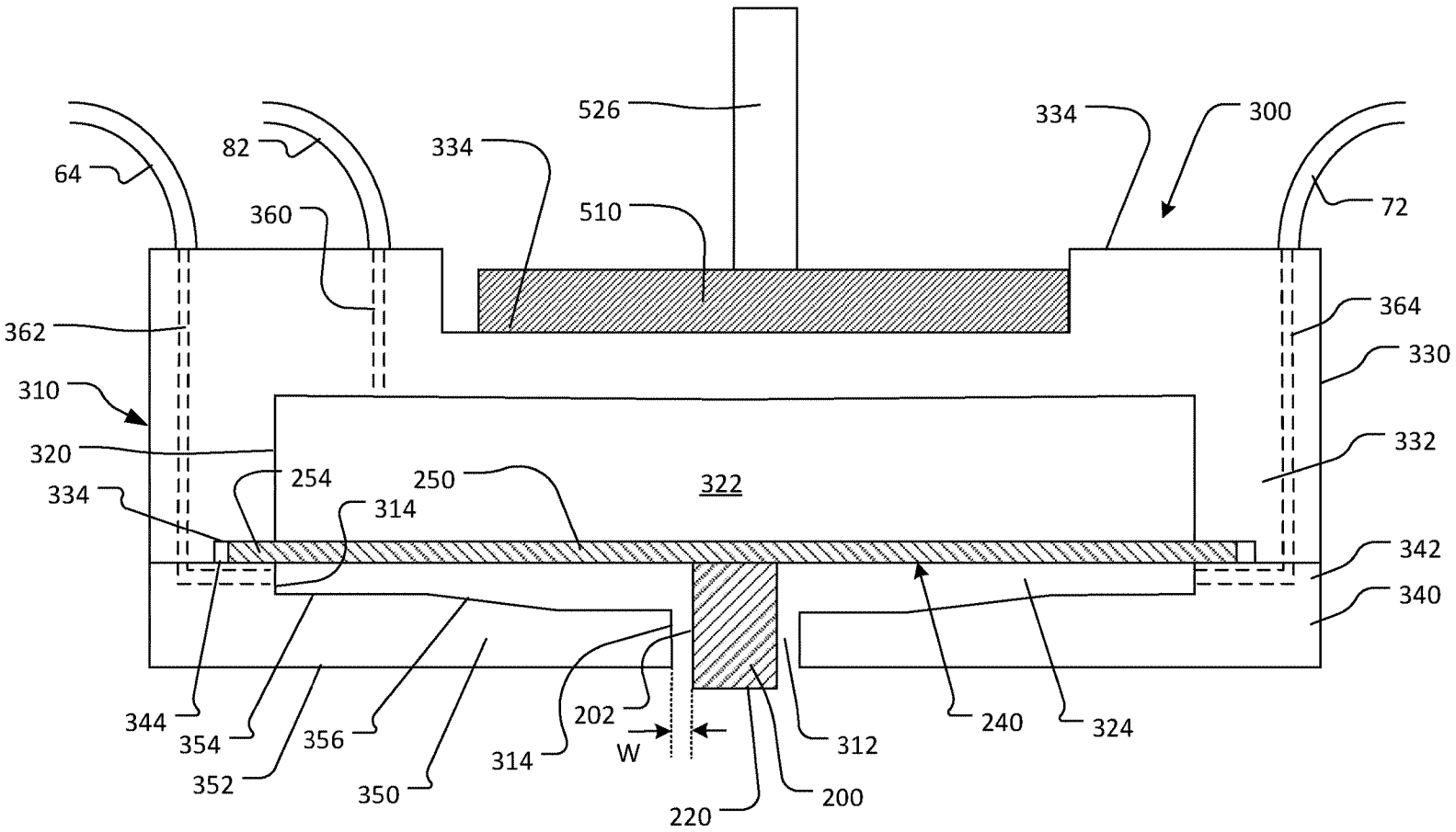
FIG. 6 is a schematic cross-sectional view of a polishing pad carrier.

Referring to FIG. 6, the polishing pad assembly 240 is held by the polishing pad carrier 300, which is configured to provide a controllable downward pressure on the polishing pad portion 200.

The polishing pad carrier includes a casing 310. The casing 310 can generally surround the polishing pad assembly 240. For example, the casing 310 can include an inner cavity in which at least the membrane 250 of the polishing pad assembly 250 is positioned.

The casing 310 also includes an aperture 312 into which the polishing pad portion 200 extends. The side walls 202 of the polishing pad 200 can be separated from the side walls 314 of the aperture 312 by a gap having a width W of, for example, about 0.5 to 2 mm. The side walls 202 of the polishing pad 200 can be parallel to the side walls 314 of the aperture 312.

The membrane 250 extends across the cavity 320 and divides the cavity 320 into a upper chamber 322 and a lower chamber 324. The aperture 312 connects the lower chamber 324 to the exterior environment. The membrane 254 can seal the upper chamber 320 so that it is pressurizable. For example, assuming the membrane 250 is fluid-impermeable, the edges 254 of the membrane 250 can be clamped to the casing 310.

In some implementations, the casing 310 includes an upper portion 330 and a lower portion 340. The upper portion 330 can include a downwardly extending rim 332 that will surround the upper chamber 322, and the lower portion 340 can include an upwardly extending rim 342 that will surround the lower chamber 342.

The upper portion 330 can be removably secured to the lower portion 340, e.g., by screws that extend through holes in the upper portion 330 into threaded receiving holes in the lower portion 340. Making the portions removably securable permits the polishing pad assembly 240 to be removed and replaced when the polishing pad portion 200 has been worn.

The edges 254 of the membrane 250 can be clamped between the upper portion 330 and the lower portion 340 of the casing 310. For example, the edge 254 of the membrane 250 is compressed between the bottom surface 334 of the rim 332 of the upper portion 330 and the top surface 342 of the rim 342 of the lower portion 340. In some implementations, either the upper portion 330 or the lower portion 332 can include a recessed region formed to receive the edge 254 of the membrane 250.

The lower portion 340 of the casing 310 includes a flange portion 350 that extends horizontal and inwardly from the rim 342. The lower portion 340, e.g., the flange 350, can extend across the entire membrane 250 except for the region of the aperture 312. This can protect the membrane 250 from polishing debris, and thus prolong the life of the membrane 250.

A first passage 360 in the casing 310 connects the conduit 82 to the upper chamber 322. This permits the pressure source 80 to control the pressure in the chamber 322, and thus the downward pressure on and deflection of the membrane 250, and thus the pressure of the polishing pad portion 200 on the substrate 10.

In some implementations, when the upper chamber 322 is at normal atmospheric pressure, the polishing pad portion extends 200 entirely through the aperture 312 and projects beyond the lower surface 352 of the casing 310. In some implementations, when the upper chamber 322 is at normal atmospheric pressure, the polishing pad portion 200 extends only partially into the aperture 312, and does not project beyond the lower surface 352 of the casing 310. However, in this later case, application of appropriate pressure to the upper chamber 322 can cause the membrane 250 to deflect such that the polishing pad portion 200 projects beyond the lower surface 352 of the casing 310.

An optional second passage 362 in the casing 310 connects the conduit 64 to the lower chamber 324. During a polishing operation, slurry 62 can flow from the reservoir 60 into the lower chamber 324, and out of the chamber 324 through the gap between the polishing pad portion 200 and the lower portion of the casing 310. This permits slurry to provided in close proximity to the portion of the polishing pad that contacts the substrate. Consequently, slurry can be supplied in lower quantity, thus reducing cost of operation.

An optional third passage 364 in the casing 310 connects the conduit 72 to the lower chamber 324. In operation, e.g., after a polishing operation, cleaning fluid can flow from the source 70 into the lower chamber 324. This permits the polishing fluid to be purged from the lower chamber 324, e.g., between polishing operations. This can prevent coagulation of slurry in the lower chamber 324, and thus improve the lifetime of the polishing pad assembly 240 and decrease defects.

A lower surface 352 of the casing 310, e.g., the lower surface of the flange 350, can extend substantially parallel to the top surface 12 of the substrate 10 during polishing. An upper surface 354 of the flange 344 can include a sloped area 356 that, measured inwardly, slopes away from the outer upper portion 330. This sloped area 356 can help ensure that the membrane 250 does not contact the inner surface 354 when the upper chamber 322 is pressurized, and thus can help ensure that the membrane 250 does not block the flow of the slurry 62 through the aperture 312 during a polishing operation. Alternatively or in addition, the upper surface 354 of the flange 354 can include channels or grooves. If the membrane 250 contacts the upper surface 354 then slurry can continue to flow through the channels or grooves.

Although FIG. 3 illustrates the passages 362 and 364 as emerging in a side wall of the rim 342 of the lower portion 340, other configurations are possible. For example, either or both passages 362 and 364 can emerge in the inner surface 354 of the flange 354 or even in the side wall 314 of the aperture 312.

5. The Drive System and Orbital Motion of the Pad

Figure 7:
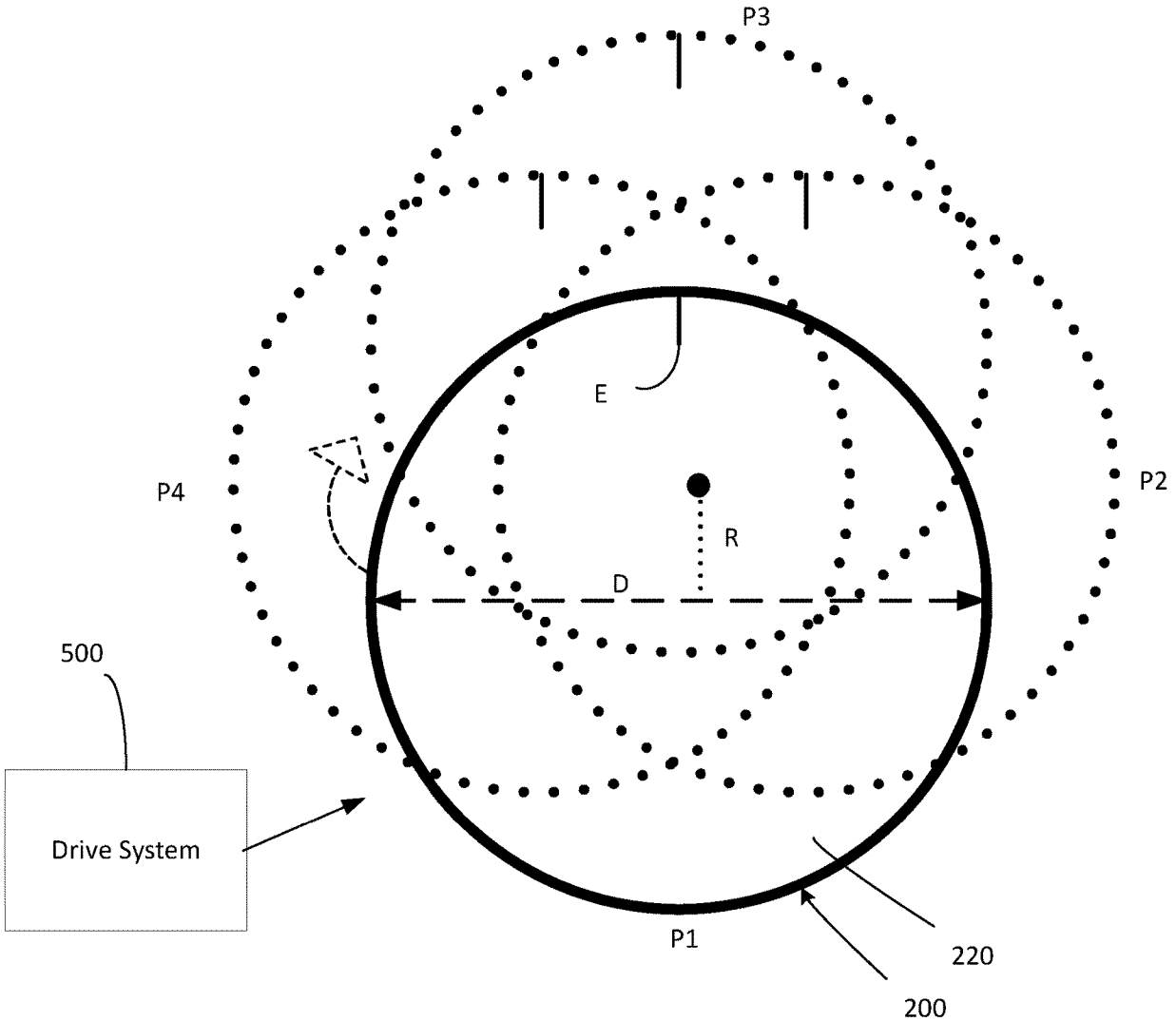
FIG. 7 is a schematic cross sectional top view illustrating a polishing pad portion that moves in an orbit while maintaining a fixed angular orientation.
Figure 8:
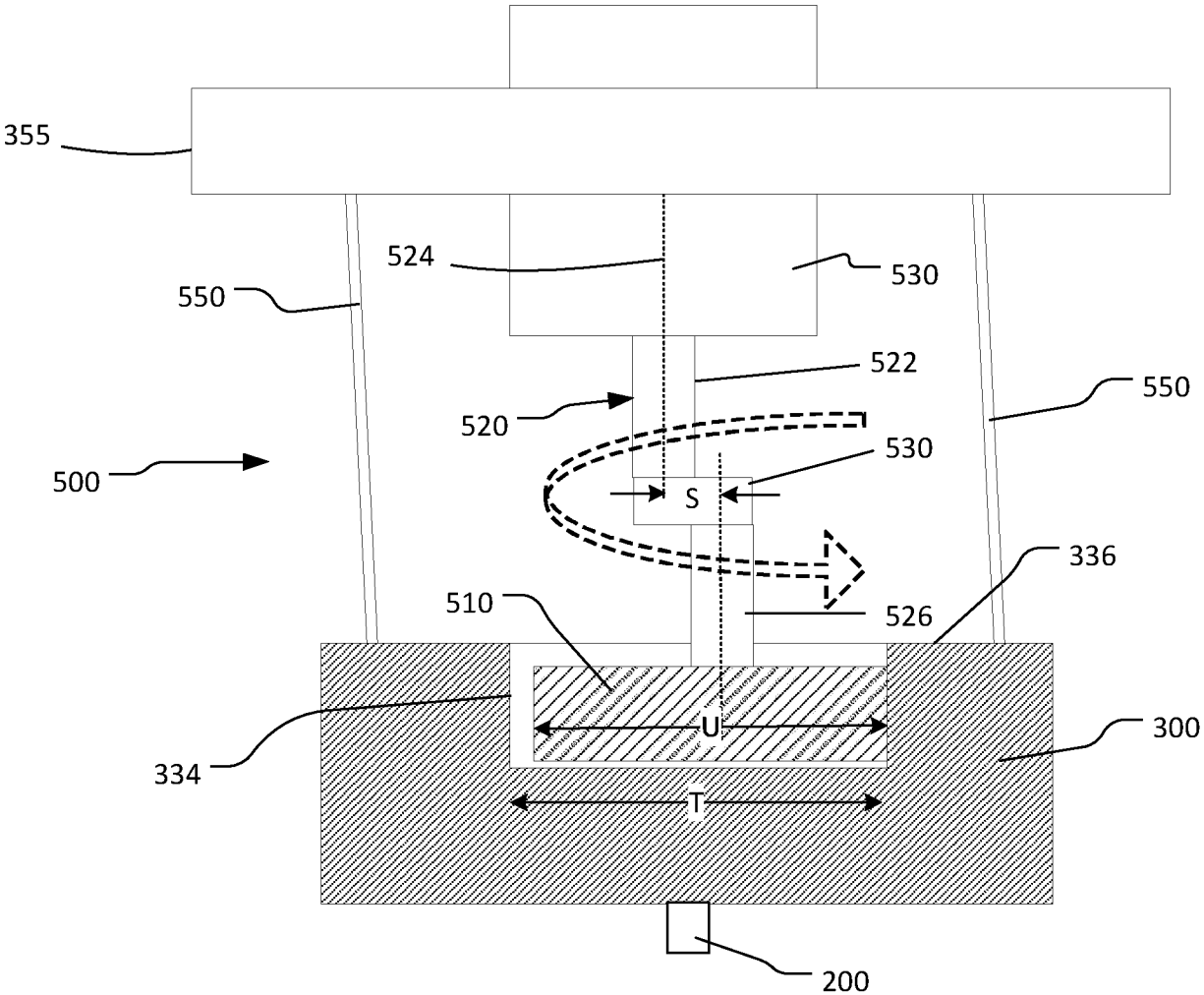
FIG. 8 is a schematic cross-sectional side view of the polishing pad carrier and drive train system of a polishing system.

Referring to FIGS. 1, 7 and 8, the polishing drive system 500 can be configured to move the coupled polishing pad carrier 300 and polishing pad portion 200 in an orbital motion during the polishing operation. In particular, as shown in FIG. 7, the polishing drive system 500 can be configured to maintain the polishing pad in a fixed angular orientation relative to the substrate during the polishing operation.

FIG. 7 illustrates an initial position P1 of the polishing pad portion 200. Additional positions P2, P3 and P4 of the polishing pad portion 200 at one-quarter, one-half, and three-quarters, respectively, of travel through the orbit are shown in phantom. As shown by position of edge marker E, the polishing pad remains in a fixed angular orientation relative during travel through the orbit.

Still referring to FIG. 7, the radius R of orbit of the polishing pad portion 200 in contact with the substrate can smaller than the largest lateral dimension D of the polishing pad portion 200. In some implementations, the radius R of orbit of the polishing pad portion 200 is smaller than the smallest lateral dimension of the contact area. In the case of a circular polishing area, the largest lateral dimension D of the polishing pad portion 200. For example, the radius of orbital can be about 5-50%, e.g., 5-20%, of the largest lateral dimension of the polishing pad portion 200. For a polishing pad portion that is 20 to 30 mm across, the radius of orbit can be 1-6 mm. This achieves a more uniform velocity profile in the contact area of the polishing pad portion 200 against the substrate. The polishing pad should preferably orbit at a rate of 1,000 to 5,000 revolutions per minute ("rpm").

Referring to FIGS. 1, 6, and 8 the drive train of the polishing drive system 500 can achieves orbital motion with a single actuator 540, e.g., a rotary actuator. A circular recess 334 can be formed in the upper surface 336 of the casing 310, e.g., in the top surface of the upper portion 330. A circular rotor 510 having a diameter equal to or less than that of the recess 334 fits inside the recess 334, but is free to rotate relative to the polishing pad carrier 300. The rotor 510 is connected to a motor 530 by an offset drive shaft 520. The motor 530 can be suspended from the support structure 355, and can be attached to and move with the moving portion of the positioning drive system 560.

The offset drive shaft 520 can include an upper drive shaft portion 522 that is connected to the motor 540 rotates about an axis 524. The drive shaft 520 also includes a lower drive shaft portion 526 that is connected to the upper drive shaft 522 but laterally offset from the upper drive shaft 522, e.g., by a horizontally extending portion 528.

In operation, rotation of the upper drive shaft 522 causes the lower drive shaft 526 and the rotor 510 to both orbit and rotate. Contact of the rotor 510 against the inside surface of the recess 334 of the casing 310 forces the polishing pad carrier 300 to undergo a similar orbital motion.

Assuming the lower drive shaft 520 connects to the center of the rotor 510, the lower drive shaft 520 can be offset from the upper drive shaft 522 by a distance S that provides a desired radius R of orbit. In particular, if the offset causes the lower drive shaft 522 to revolve in a circle with a radius S, the diameter of the recess 344 is T, and the diameter of the rotor is U, then $$R = S - \left(\frac{T-U}{2}\right)$$

A plurality of anti-rotation links 550, e.g., four links, extend from the positioning drive system 560 to the polishing pad carrier 300 to prevent rotation of the polishing pad carrier 300. The anti-rotation links 550 can be rods that fit into receiving holes in the polishing pad carrier 300 and support structure 500. The rods can be formed of a material, e.g., Nylon, that flexes but generally does not elongate. As such, the rods are capable of slight flexing to permit the orbital motion of the polishing pad carrier 300 but prevent rotation. Thus, the anti-rotation links 550, in conjunction with motion of the rotor 510, achieve an orbital motion of the polishing pad carrier 300 and the polishing pad portion 200 in which the angular orientation of the polishing pad carrier 300 and the polishing pad portion 200 does not change during the polishing operation. An advantage of orbital motion is a more uniform velocity profile, and thus more uniform polishing, than simple rotation. In some implementations, the anti-rotation links 550 can be spaced at equal angular intervals around the center of the polishing pad carrier 300.

In some implementations, the polishing drive system and the positioning drive system are provided by the same components. For example, a single drive system can include two linear actuators configured to move the pad support head in two perpendicular directions. For positioning, the controller can cause the actuators to move the pad support to the desired position on the substrate. For polishing, the controller can cause the actuators to the actuators to move the pad support in the orbital motion, e.g., by applying phase offset sinusoidal signals to the two actuators.

In some implementations, the polishing drive system can include two rotary actuators. For example, the polishing pad support can be suspended from a first rotary actuator, which in turn is suspended from a second rotary actuator. During the polishing operation, the second rotary actuator rotates an arm that sweeps the polishing pad carrier in the orbital motion. The first rotary actuator rotates, e.g., in the opposite direction but at the same rotation rate as the second rotary actuator, to cancel out the rotational motion such that the polishing pad assembly orbits while remaining in a substantially fixed angular position relative to the substrate.

6. Conclusion

The size of a spot of non-uniformity on the substrate will dictate the ideal size of the loading area during polishing of that spot. If the loading area is too large, correction of underpolishing of some areas on the substrate can result in overpolishing of other areas. On the other hand, if the loading area is too small, the pad will need to be moved across the substrate to cover the underpolished area, thus decreasing throughput. Thus, this implementation permits the loading area to be matched to the size of the spot.

In contrast with rotation, an orbital motion that maintains a fixed orientation of the polishing pad relative to the substrate provide a more uniform polishing rate across the region being polished.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers.

A number of embodiments of the invention have been described. Nevertheless, it will be understood that various modifications may be made without departing from the spirit and scope of the invention. For example, the substrate support could, in some embodiments, include its own actuators capable of moving the substrate into position relative to the polishing pad. As another example, although the system described above includes a drive system that moves the polishing pad in the orbital path while the substrate is held in a substantially fixed position, instead the polishing pad could be held in a substantially fixed position and the substrate moved in the orbital path. In this situation, the polishing drive system could be similar, but coupled to the substrate support rather than the polishing pad support.

Although generally circular substrate is assumed, this is not required and the support and/or polishing pad could be other shapes such as rectangular (in this case, discussion of "radius" or "diameter" would generally apply to a lateral dimension along a major axis).

Terms of relative positioning are used to denote positioning of components of the system relative to each other, not necessarily with respect to gravity; it should be understood that the polishing surface and substrate can be held in a vertical orientation or some other orientations. However, the arrangement relative to gravity with the aperture in the bottom of the casing can be particular advantageous in that gravity can assist the flow of slurry out of the casing.

Accordingly, other embodiments are within the scope of the following claims.

What is claimed is:

1. A polishing pad assembly, comprising:

a circular membrane; and a polishing pad portion having a perimeter that forms a convex circular shape and having a polishing surface to contact a substrate during a polishing operation, wherein the polishing pad portion has a width at least five times smaller than a width of the membrane, wherein the polishing pad portion is positioned at about a center of the circular membrane, wherein an upper surface of the polishing pad portion includes one or more recesses and one or more plateaus having a top surface that provides the polishing surface, wherein the one or more recesses comprise a first plurality of parallel grooves and a second plurality of parallel grooves perpendicular to the first plurality of parallel grooves, and wherein the polishing surface has a plurality of edges defined by intersections between side walls of the one or more recesses and the top surface of the one or more plateaus.

2. The assembly of claim 1, wherein the first plurality of parallel grooves is exactly two to six grooves, and the second plurality of parallel grooves is the same number of grooves.

3. The assembly of claim 1, wherein the membrane and the polishing pad portion are a unitary body.

4. The assembly of claim 1, wherein the polishing pad portion is secured to the membrane by an adhesive.

5. The assembly of claim 1, wherein the membrane comprises a first portion surrounded by a less flexible second portion, and the polishing pad portion is joined to the first portion.

* * * * *